US008485494B2

(12) United States Patent
Sanders

(10) Patent No.: US 8,485,494 B2
(45) Date of Patent: Jul. 16, 2013

(54) HINGED MOLD FOR PRE-FORMED CONCRETE ELEMENTS

(76) Inventor: Mark E. Sanders, Zionsville, IN (US)

( * ) Notice: Subject to any disclaimer, the term of this patent is extended or adjusted under 35 U.S.C. 154(b) by 0 days.

(21) Appl. No.: 13/075,933

(22) Filed: Mar. 30, 2011

(65) Prior Publication Data

US 2011/0253879 A1 Oct. 20, 2011

Related U.S. Application Data

(60) Provisional application No. 61/325,439, filed on Apr. 19, 2010.

(51) Int. Cl.
*B28B 7/04* (2006.01)

(52) U.S. Cl.
USPC ..... 249/112; 249/113; 249/120; 249/158; 249/162; 249/169; 249/170; 249/189; 249/195

(58) Field of Classification Search
USPC ..... 249/112, 113, 120, 139, 155, 158, 249/160–162, 168–172, 189, 193, 195; 264/34, 264/333
See application file for complete search history.

(56) References Cited

U.S. PATENT DOCUMENTS

| | | | | | |
|---|---|---|---|---|---|
| 770,677 | A | * | 9/1904 | Cuatt | 249/75 |
| 787,099 | A | * | 4/1905 | Keagy | 249/64 |
| 854,613 | A | * | 5/1907 | Thomas et al. | 249/147 |
| 880,495 | A | * | 3/1908 | Barnes | 249/120 |
| 881,912 | A | * | 3/1908 | Emrick | 249/141 |
| 896,330 | A | * | 8/1908 | Scheelky | 249/93 |
| 987,225 | A | * | 3/1911 | Fobes | 249/144 |
| 1,143,769 | A | * | 6/1915 | Leonard | 249/96 |
| 1,415,213 | A | * | 5/1922 | White | 249/112 |
| 1,484,855 | A | * | 2/1924 | Winn | 249/137 |
| 1,533,830 | A | * | 4/1925 | White | 249/103 |
| 1,708,646 | A | * | 4/1929 | Zlatnik | 249/108 |
| 2,172,466 | A | * | 9/1939 | Edwardes et al. | 264/225 |
| 2,892,339 | A | * | 6/1959 | Flower et al. | 52/608 |
| 3,204,316 | A | * | 9/1965 | Jackson | 249/13 |
| 3,349,457 | A | * | 10/1967 | Frantz | 425/117 |
| 3,602,476 | A | * | 8/1971 | Iragorri | 249/96 |
| 3,641,228 | A | * | 2/1972 | Fleck | 264/53 |
| 3,689,020 | A | | 9/1972 | Martin | |
| 3,809,357 | A | * | 5/1974 | Gallap | 249/161 |

(Continued)

FOREIGN PATENT DOCUMENTS

| | | | |
|---|---|---|---|
| DE | 3443286 | A1 * | 6/1986 |
| JP | 01297213 | A * | 11/1989 |

*Primary Examiner* — Dimple Bodawala
(74) *Attorney, Agent, or Firm* — Maginot, Moore & Beck LLP

(57) ABSTRACT

The concepts disclosed herein provide for a concrete mold that improves upon existing concrete molds known in the art. The hinged side-panel members that are locked to a hold-down frame allow for the mold to cure a concrete member, and then allow the concrete member to be removed without the need to break-down the frame surrounding the concrete member. During the pouring and ensuing curing process of the concrete member, the hinged side-panel members are secured to the hold-down frame and to each other in order to hold the concrete in the mold. Once the concrete is cured, the hinged side-panel members may be unlocked and opened quickly, allowing for expedient removal of the concrete member. After closing and re-locking the hinged side-panel members, the mold may be reused to cure another concrete member without the need to rebuild the frame around the mold.

9 Claims, 8 Drawing Sheets

U.S. PATENT DOCUMENTS 3,875,278 A * 4/1975 Brandt ..... 264/510
3,885,008 A * 5/1975 Martin ..... 264/45.3
4,033,545 A * 7/1977 Duwe et al. ..... 249/98
4,482,126 A * 11/1984 Toffolon ..... 249/159
4,520,988 A 6/1985 Walker
4,790,508 A * 12/1988 Henderson et al. ..... 249/11
4,842,241 A * 6/1989 Fitzgerald et al. ..... 249/50
4,958,800 A 9/1990 Carlson
5,061,161 A * 10/1991 Tetu ..... 425/3
5,372,349 A * 12/1994 Elmore ..... 249/112
5,535,981 A * 7/1996 Goris ..... 249/157
5,766,500 A * 6/1998 Bordener ..... 249/117
5,788,873 A * 8/1998 Warsaw ..... 249/170
5,817,248 A * 10/1998 Forlini ..... 249/68
5,900,180 A * 5/1999 Scott et al. ..... 249/61
6,186,469 B1 * 2/2001 Scott ..... 249/16
6,557,818 B2 * 5/2003 Manthci ..... 249/171
6,572,811 B1 * 6/2003 Heirich ..... 264/426
6,605,240 B2 8/2003 Hambelton
6,986,856 B2 * 1/2006 Pitkanen ..... 264/219
7,121,520 B2 * 10/2006 Khoo ..... 249/157
8,146,882 B2 * 4/2012 Corredor Molguero et al. ..... 249/139
2002/0061342 A1 5/2002 Jensen
2005/0064128 A1 * 3/2005 Lane et al. ..... 428/44
2007/0096353 A1 * 5/2007 Gordon et al. ..... 264/69
2007/0194205 A1 8/2007 Blackmon
2007/0276526 A1 * 11/2007 Swanson ..... 700/95

* cited by examiner

HINGED MOLD FOR PRE-FORMED CONCRETE ELEMENTS

PRIORITY CLAIM

This application claims priority to U.S. Provisional Application No. 61/325,439, which is entitled "Hinged Mold for Pre-Formed Concrete Elements" and was filed on Apr. 19, 2010, the entire disclosure of which is incorporated herein by reference.

BACKGROUND

The present inventions relate to apparatuses and methods for fabricating pre-formed concrete elements, and more particularly to forms used in making pre-formed concrete elements.

Pre-formed concrete elements are widely used in building and industrial construction. For instance, pre-formed walls may be manufactured off-site and then shipped to a building site to be erected in the building construction. Other pre-formed elements include support walls, retention or barrier walls, and ground panels. The use of pre-formed concrete elements avoids uncertainties of pouring concrete at a jobsite, such as weather and temperature. Producing pre-formed elements off-site also allows for improved quality control.

Improvements in fabrication of pre-formed concrete elements are always desired, especially improvements that can reduce material usage and improve fabrication speed. Current forms used to shape pre-formed concrete elements typically include wooden frames that are nailed or screwed together. After a concrete element has set, these frames are broken apart to release the concrete element. Creating the form, breaking it apart and recreating the form is a time consuming process. Additionally, the mechanical wear on the frame members means that they must be replaced frequently, increasing the monetary cost of the process as well. It is therefore desirable to have concrete forms that allow for faster fabrication of pre-formed concrete elements while increasing the useable lifespan of the concrete forms.

SUMMARY

In accordance with one embodiment of the disclosure, there is provided a mold, comprising a casting bed, a liner configured to rest on a surface of the casting bed, a frame configured to rest on a surface of the liner opposite the surface of the casting bed, and a form attached to a surface of the frame opposite the surface of the liner. The form comprises a plurality of side-panel members, and each side-panel member includes ends which are complimentarily configured to fit together to create a closed perimeter. The plurality of side-panel members are in a closed position when the ends of each of the plurality of side-panels are engaged to create the closed perimeter.

At least one of the plurality of side-panel members includes at least one hinge that connects the side-panel member to the frame. The frame includes hinge eyelets and the hinge includes longitudinal openings. The hinge eyelets and the longitudinal openings are simultaneously engaged by a connector which allows the side-panel member to rotate about the connector relative to the frame. The hinged side-panels are in an open position when the side-panel members have been rotated about the connector and the ends of each of the side-panels are no longer engaged to create the closed perimeter.

At least one of the plurality of side-panel members includes at least one hold-down collar and the frame includes at least one corresponding hold-down pin. The hold-down collar is configured to engage the hold-down pin when the plurality of side-panels are in the closed position, and to disengage the hold-down pin to allow the side-panel members to be rotated to the open position. In some alternative embodiments, more than one of the plurality of side-panel members includes at least one hinge and at least one hold-down collar.

In accordance with another embodiment of the disclosure, the frame comprises at least one hold-down member, or in alternative embodiments, at least two hold-down members. Each of the hold-down members includes chamfered edges configured to enable the at least two hold-down members to fit together.

In accordance with another embodiment of the disclosure, there is provided a method comprising fastening a liner to a casting bed, fastening a frame to the liner, attaching a plurality of side-panel members to the frame (the side-panel members having ends which are configured to fit complimentarily together), engaging the ends of each of the side-panel members to form a closed perimeter, pouring a moldable material in the closed perimeter, allowing the moldable material to set, disengaging the ends of the side-panel members to create an opening in the perimeter, and removing the moldable material from the perimeter.

In an alternative embodiment, disengaging the ends of the side-panel members further comprises rotating the side-panel members about a hinge connected to the frame. In another alternative embodiment, removing the moldable material from the perimeter further comprises applying leverage on the moldable material through the opening in the perimeter.

In alternative embodiments, engaging the ends of each of the side-panel members to form a closed perimeter further comprises engaging hold-down pins on the frame with hold-down collars on the side-panel members to prevent disengaging of the ends of the side-panel members. Disengaging the ends of the side-panel members to create an opening in the perimeter further comprises disengaging hold-down pins from the hold-down collars to allow disengaging of the ends of the side-panel members. Disengaging the ends of the side-panel members to create an opening in the perimeter also further comprises rotating the side-panel members about a hinge connected to the frame and to the side-panel members. Removing the moldable material from the perimeter further comprises applying leverage on the moldable material through the opening in the perimeter.

In yet another alternative embodiment, fastening the frame to the liner further comprises fitting together frame elements which have chamfered corners.

The above described features and advantages, as well as others, will become more readily apparent to those of ordinary skill in the art by reference to the following detailed description and accompanying drawings. While it would be desirable to provide a pre-form mold that provides one or more of these or other advantageous features, the teachings disclosed herein extend to those embodiments which fall within the scope of the appended claims, regardless of whether they accomplish one or more of the above-mentioned advantages.

DETAILED DESCRIPTION

Figure 1:
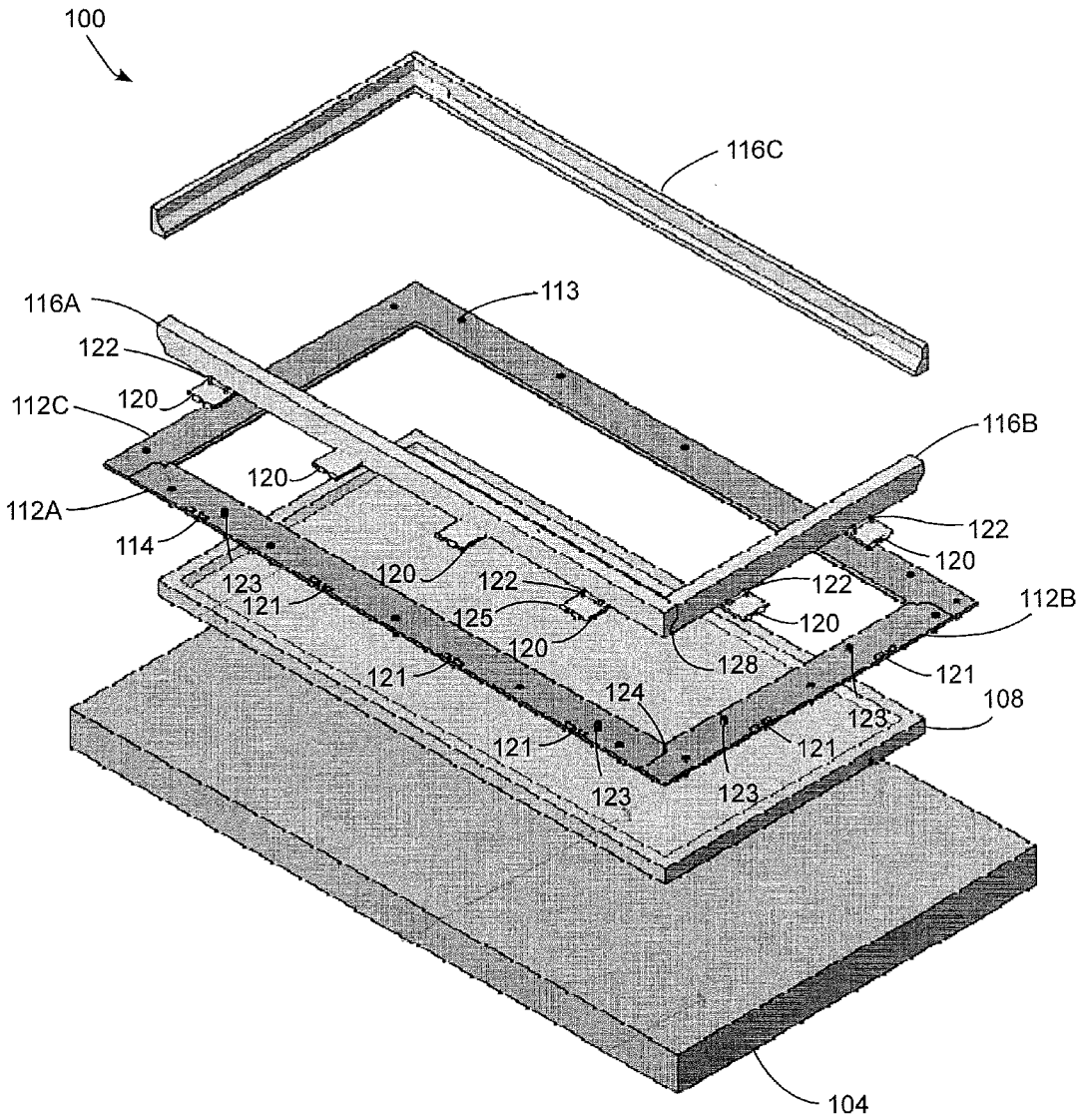
FIG. 1 is an exploded view of a pre-form mold incorporating a hold-down frame and hinged side-panel members according to a disclosed embodiment.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

An improved mold 100 for forming concrete elements is depicted in FIG. 1. The mold 100 may be configured to produce pre-cast panels, such as for use in retention, barrier or sound absorption walls. As used herein, the term "concrete" may include any cementitious mixture that is poured into a mold for curing. This includes concretes using any of a variety of aggregate materials, as well as cements. It is further contemplated that the mold 100 may be used with other moldable materials, such as moldable polymers or polymer composites.

Mold 100 includes a casting bed 104 that provides a stable and level foundation to support the mold 100 and the concrete during the setting and curing process. Casting bed 104 may be primarily composed of one or more plywood sheets. Form liner 108 is set above casting bed 104. Concrete poured into mold 100 rests on form liner 108 during the setting process. Form liner 108 may include a variety of shapes, patterns or contours in its surface that are transferred into the surface of the hardened concrete. Form liner 108 primarily consists of a material that is easily separated from the cured concrete. Plastic liners, for example, are commonly used for this purpose.

Mold 100 further includes a hold-down frame assembled above form liner 108. The hold-down frame shown in FIG. 1 includes hold-down members 112A, 112B, and 112C. The hold-down members 112A-C each have chamfered corners that allow the hold-down members 112A-C to fit together as seen at hold-down member joint 124. While the corners seen in FIG. 1 have a chamfered shape, alternative embodiments of hold-down members may employ squared corners. Additionally, alternative embodiments may employ a hold-down frame made of more or less than three separate hold-down members. For example, one alternative embodiment may employ a single-piece hold-down frame rather than a hold-down frame made of separate hold-down members 112A-C.

Hold-down members 112A-C are locked together as shown in FIG. 1, and are secured to casting bed 104 with screws, bolts or other fasteners (not shown) extending through a plurality of mounting holes exemplified by mounting hole 113. The hold-down frame additionally secures form liner 108 to the casting bed 104.

Side-panel members 116A, 116B, and 116C are secured above the hold-down frame. As shown in FIG. 1, side-panel members 116A-C are mounted atop hold-down frame members 112A-C, respectively. Side-panel members 116A-C hold concrete in place during the curing process, and may have a contoured interior shape, as shown by side-panel member 116C. For instance, side-panel member 116C has a rail contour in its interior surface which will form a groove in the side of the cured concrete. The contoured interior shape imparts a contoured edge to the concrete shaped in the mold 100.

The main body of each side-panel member 116A-C is primarily composed of a material that is easily separated from cured concrete, such as wood. The exemplary side-panel members 116A-C fit together with chamfered edges as seen at side-panel member joint 128. The chamfering provides a secure seal at side-panel member joints 128 to contain concrete poured in the mold 100. In alternative embodiments, side-panel member joints 128 may include perpendicular edges or any other configuration which provides a secure seal at side-panel member joints 128. In another alternative embodiment, alternative joint shapes and structures such as gaskets or elastic seals may be used to seal side-panel member joints 128.

Figure 8:
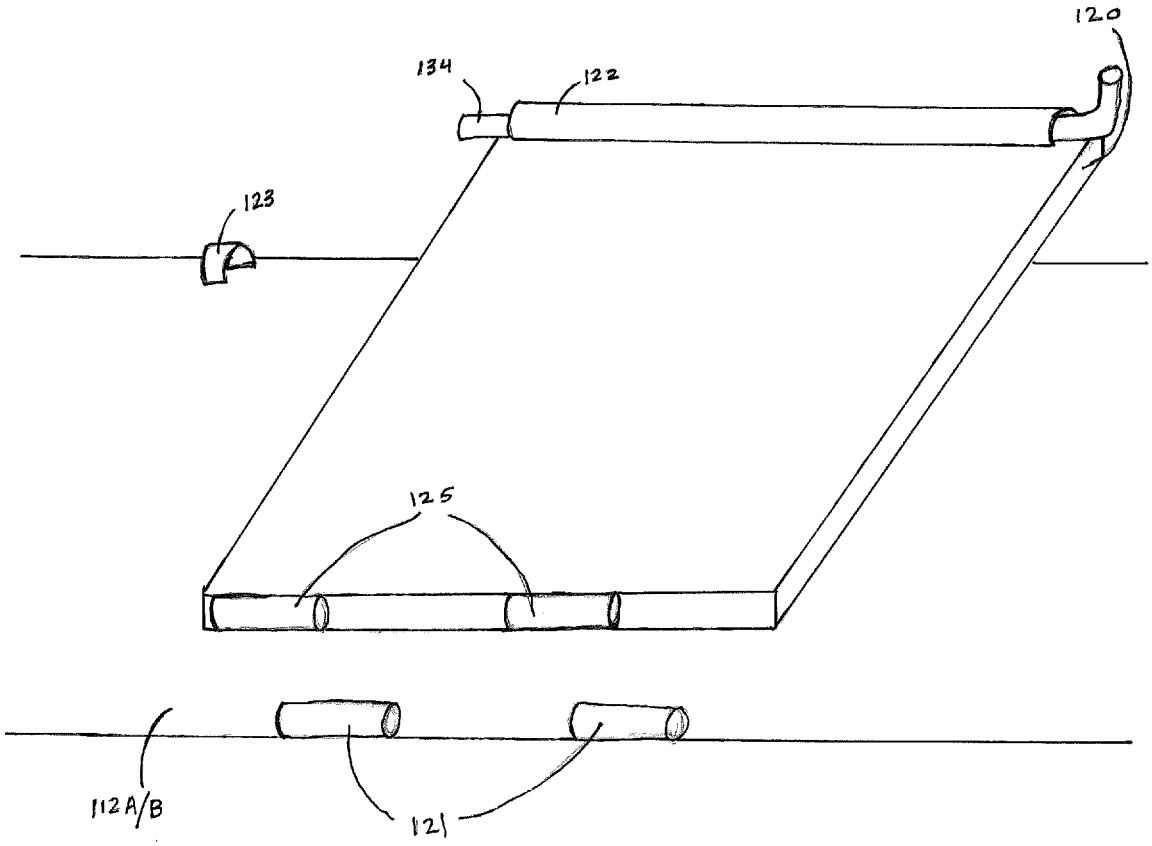
FIG. 8 is an exploded view of a hinge like that used in FIGS. 1-7.

Side-panel members 116A and 116B each include at least one hinge member 120. One embodiment of a hinge member 120, which will be discussed below in more detail, is shown in FIG. 8. Hinge members 120 include longitudinal openings 125 positioned to correspond with hinge eyelets 121 on the hold-down members 112A and 112B. Some of the hinge members 120 also include hold-down collars 122. Hold-down collars 122 are positioned to engage corresponding hold-down posts 123 on the hold-down members 112A and 112B.

Figure 2:
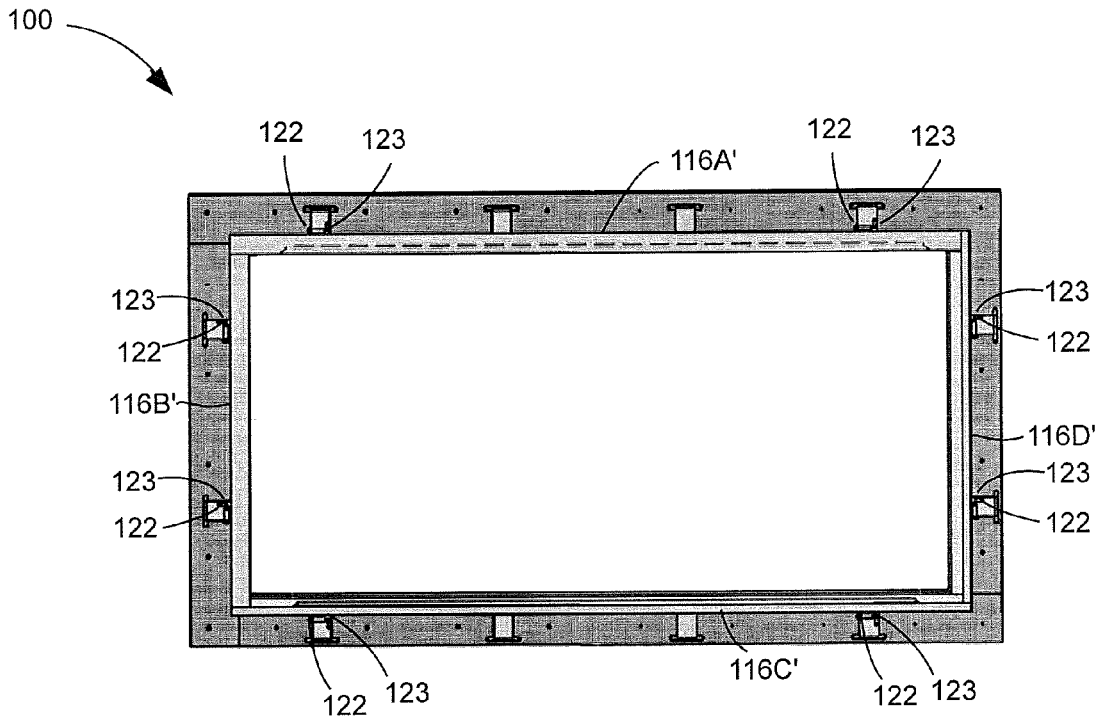
FIG. 2 is a plan view of a pre-form mold with hinged side-panels on four sides in a closed position, according to a further disclosed embodiment.
Figure 4:
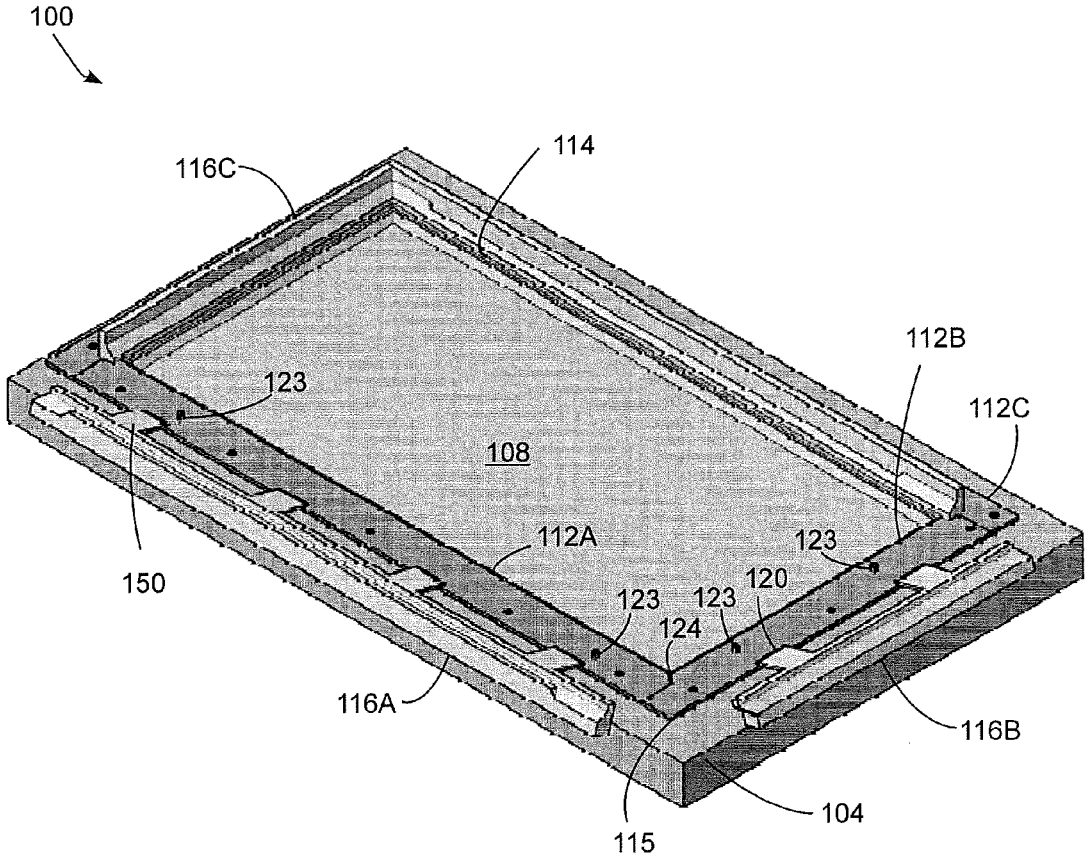
FIG. 4 is a perspective view of the pre-form mold of FIG. 1 with the hinged side-panel members in an open position.

FIG. 1 and FIG. 4 depict a concrete mold 100 having four sides and three side-panel members 116A-C, with adjoining side-panel members 116A and 116B being configured with hinge members 120, and side-panel 116C not hinged, but secured to hold-down member 112C; however, alternative embodiments are also envisioned. For example, as shown in FIG. 2, alternative side-panel member configurations may include hinged side-panel members 116A', 116B', 116C' and 116D', hold-down collars 122 and hold-down posts 123 on all four sides of a concrete mold 100. In yet another alternative embodiment, the side-panel members 116A-C having hinge members 120 may be placed on opposing sides of the concrete mold 100. In other alternative embodiments, concrete molds 100 may have shapes with more or fewer than four sides employing side-panel members 116 with hinge members 120 on some or all of the sides of the mold 100.

Figure 3A:
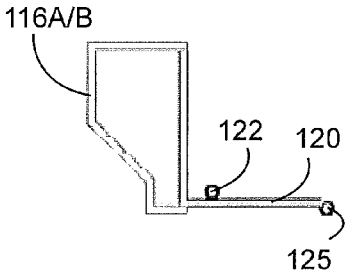
FIGS. 3A-3F are side views of hinged side-panel members of the mold shown in FIG. 1.
Figure 3B:
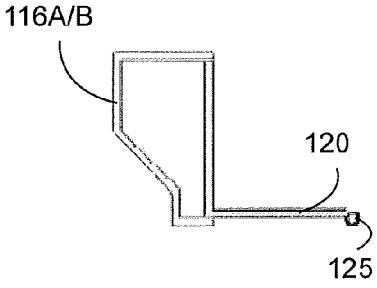
Figure 3C:
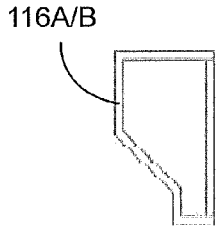

FIGS. 3A-3F depict cross-sectional views of side-panel members. FIGS. 3A-3C show the cross-sectional views of side-panel members 116A and 116B, for example. FIG. 3A depicts a section of the side-panel member 116A/B which includes a longitudinal opening 125 and a hold-down collar 122 on a hinge member 120 like that shown in the embodiment of FIG. 8, for example. As described above, the hold-down collars 122 engage with hold-down posts 123 on hold-down members 112A-C and longitudinal openings 125 correspond to hinge eyelets 121. The cross-section of FIG. 3A depicts a portion of side-panel member 116A/B which rotates about longitudinal opening 125 and may be locked in place with hold-down collar 122. FIG. 3B depicts a section of the side-panel member 116A/B which includes a longitudinal opening 125 on a hinge member 120 but no hold-down collar 122 so that the side-panel member 116A/B rotates about longitudinal opening 125 but is not locked into place. FIG. 3C depicts a section of the side-panel member 116A/B which does not include a hinge member 120. Together, FIGS. 3A-C depict the different cross-sections of side-panel member 116A/B and illustrate how the entire side-panel member 116A/B is able to rotate and lock in place utilizing hinge members 120 that can rotate and be locked in place with hinge members 120 that only rotate.

Figure 3D:
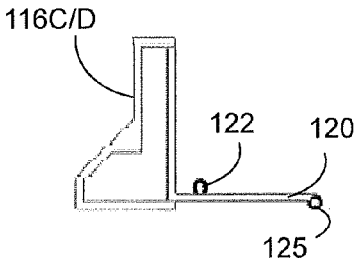
Figure 3E:
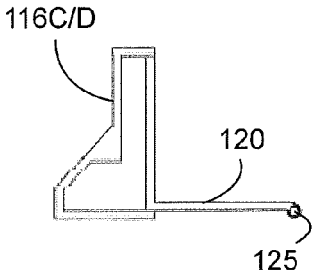
Figure 3F:
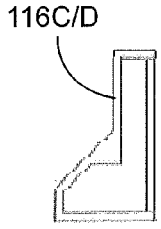

FIGS. 3D-F show cross-sectional views of side-panel members 116C' and 116D'. As described above and shown in FIG. 2, side-panel members 116C' and 116D' are hinged and include hold-down collars 122 and longitudinal openings 125. Together, FIGS. 3D-3F depict the different cross-sections of side panel member 116C'/D' and illustrate how the entire side-panel member 116C'/D' is able to rotate and lock in place utilizing hinge members 120 that can rotate and be locked in place with hinge members 120 that only rotate.

FIGS. 3A-3F also illustrate how side-panel members 116A and 116B fit together with side-panel members 116C or 116C' and 116D'. The cross-sections of side-panel members 116A and 116B are thinner on the side that contacts the hold-down members 112. Conversely, the cross-sections of side-panel members 116C or 116C'/D' are thicker on the side that contacts the hold-down members 112. The inverse shapes of side-panel members 116A/B and 116C or 116C'/D' are complementary and allow the side-panel members to form secure seals at side-panel joints between side-panel members 116A/B and 116C or 116C'/D'.

FIG. 4 depicts the concrete mold 100 of FIG. 1 in an assembled configuration. The side-panel members 116A and 116B are joined to hold-down members 112A and 112B, respectively, with hinge members 120. Each hinge member 120 includes a hinge cotter pin (not shown) that simultaneously engages the longitudinal openings 125 of the hinge members 120 of the side-panel members 116A and 116B and the hinge eyelets 121 of the hold-down members 112A and 112B. The hinge members 120 are pivoted at the outside of the hold-down members 112A-C. Thus, when the hold-down members 112A-C are fixed to the casting bed 104 (as shown in FIG. 4), the side-panel members 116A and 116B may be rotated around the hinge cotter pin relative to the hold-down members 112A and 112B. It can be appreciated that connector elements other than a cotter pin may be used at the hinge members 120. However, a cotter pin is beneficial because it can be readily removed to disassemble the side-panel members 116A-C if desired.

When the hold-down frame is assembled, as depicted in FIG. 4, the inner faces 114 of the hold-down members 112A-C are oriented toward the center of form liner 108. Conversely, the outer faces 115 of the hold-down members 112A-C are oriented away from the center of the form liner 108. In the open position depicted in FIG. 4, the side-panel members 116A and 116B are rotated about the hinge cotter pin of each hinge member 120. Relative to the hold-down members 112A and 112B, the side-panel members 116A and 116B are rotated away from the inner faces 114 and toward the outer faces 115.

Figure 5:
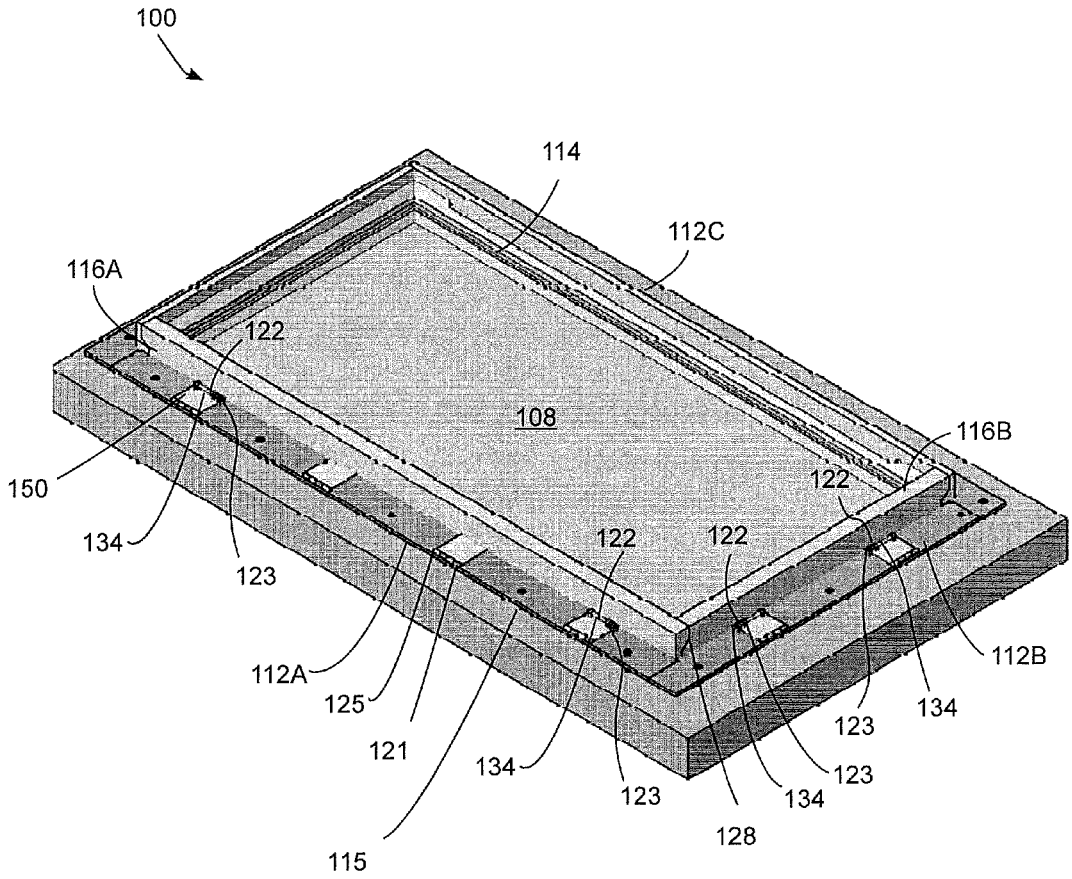
FIG. 5 is a perspective view of the pre-form mold of FIG. 1 with the hinged side-panel members in a closed position.

FIG. 5 depicts concrete mold 100 in a closed position. In the closed position, the side-panel members 116A and 116B are rotated toward the inner faces 114 and away from the outer faces 115 of the hold-down members 112A and 112B. This position of the side-panel members 116A and 116B relative to the hold-down members 112A and 112B forms a cavity into which concrete may be poured. In the closed position, the joints 128 between the side-panel members 116A-C are sealed so that the mold 100 may contain the poured concrete without leaking.

To ensure that the concrete mold 100 remains in a closed position during pouring and curing of concrete, the side-panel members 116A and 116B are locked relative to the hold-down members 112A and 112B with hold-down arrangements 150. Each hold-down arrangement 150 may include a hold-down pin 134, or a similar element, which locks the position of a side-panel 116A or 116B relative to the corresponding hold-down frame member 112A or 112B by simultaneously engaging the hold-down collar 122 and the hold-down post 123. The hold-down pins 134 secure the hold-down collars 122 included on the hinge members 120 of the side-panel members 116A-B to the corresponding hold-down posts 123 included on the hold-down members 112A-B. One embodiment of this relationship is shown in FIG. 8. In the example shown, the hold-down pin 134 is integrated within the hold-down collar 122, however the hold-down pin 134 may be in any other form which allows it to easily lock and unlock the side-panel members 116A and 116B relative to the hold-down members 112A and 112B by engaging and disengaging the hold-down collar 122 and the hold-down post 123. For example, the hold-down pin 134 may be integrated within the hold-down post 123 or may be tethered to the hold-down member 112A-B or otherwise connected to the mold 100.

While FIGS. 4 and 5 show two hold-down arrangements 150 for each side-panel member 116A-B and hold-down member 112A-B, more or fewer hold-down arrangements 150 may be used. When the mold 100 is in the closed position, the hold-down arrangements 150 are inboard, closer to the cavity than the hinge members 120 which are outboard.

Additionally, in alternative embodiments of the present disclosure, the side-panel members 116A-B may be locked in position relative to the hold-down members 112A-B by any other method which will prevent the side-panel members 116A-B from rotating outwardly relative to the hold-down members 112A-B. For example, latching the joints 128 of side-panel members 116A-C together or applying diagonal cross-braces over the joints 128 between side-panel members 116A-C may accomplish locking the side-panel members 116A and 116B in position relative to the hold-down members 112A and 112B to ensure that the side-panel members 116A-B remain in the closed position against the lateral force applied by the poured concrete.

Figure 6:
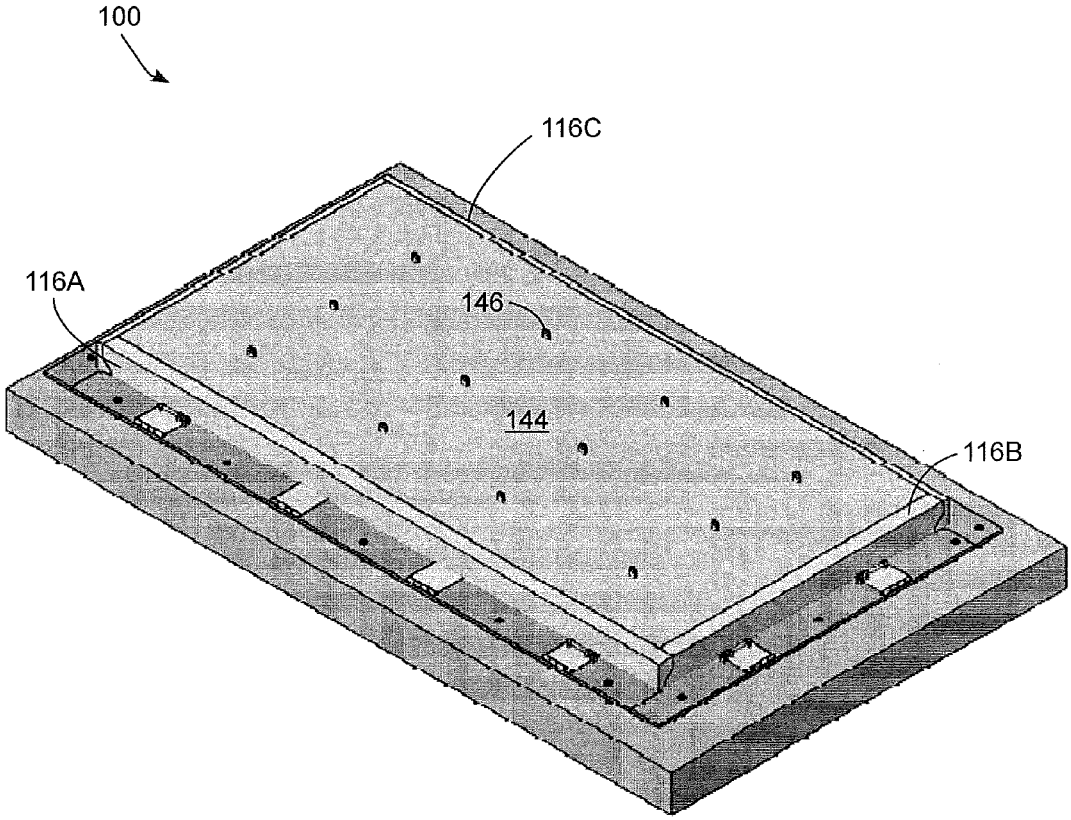
FIG. 6 is a perspective view of the pre-form mold of FIG. 1 with the hinged side-panel members in a closed position and concrete poured into the mold.

FIG. 6 depicts poured concrete contained within the mold 100 in a closed position. The concrete poured within the cavity created by the side-panel members 116A-C forms a concrete member 144. The concrete member 144 may optionally encase reinforcements 146, such as rebar.

Figure 7:
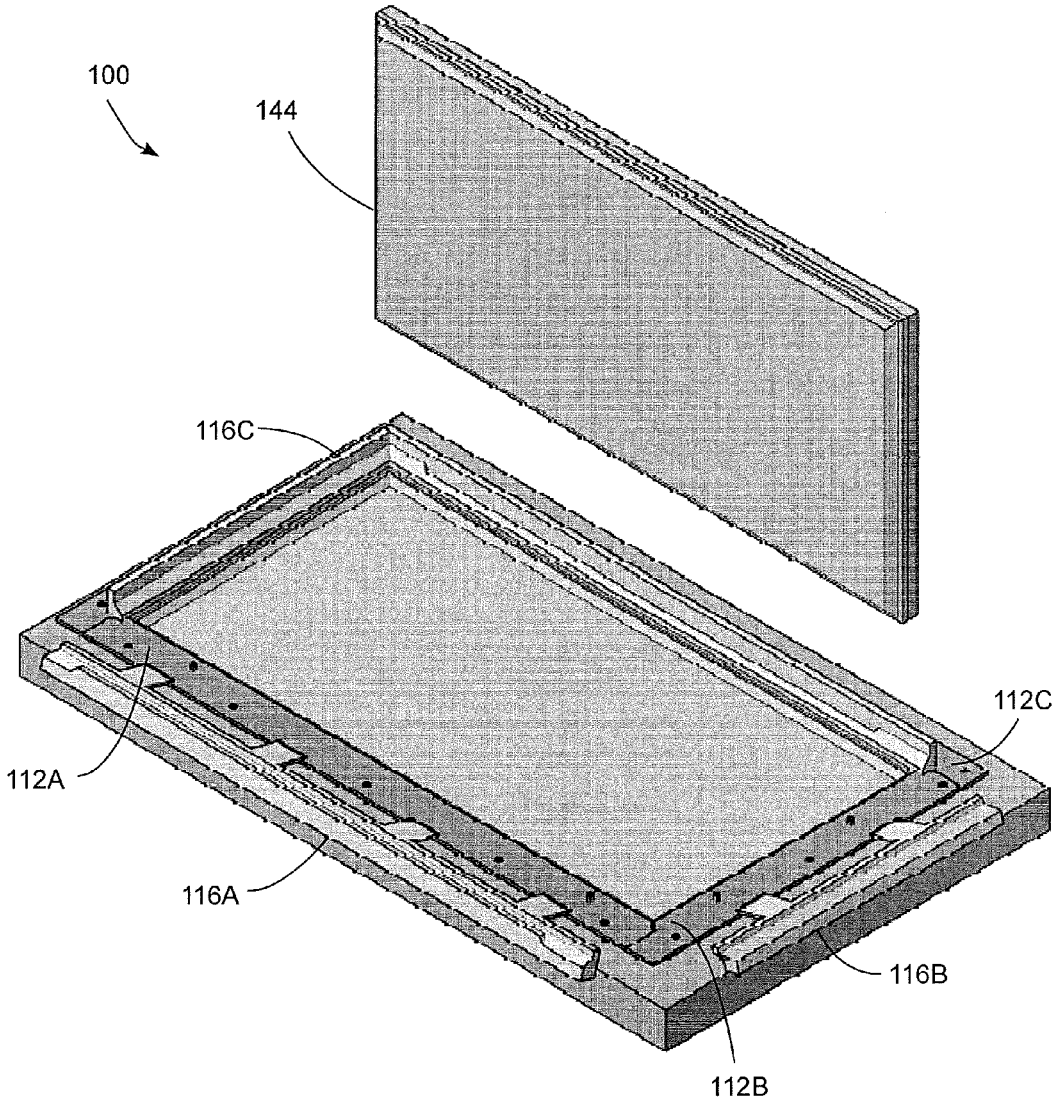
FIG. 7 is a perspective view of the pre-form mold of FIG. 1 with the hinged side-panel members in an open position and a finished concrete element removed from the mold.

As depicted in FIG. 7, after the concrete member 144 within mold 100 has cured, the side-panel members 116A and 116B are unlocked from, and are rotated outwardly relative to, hold-down frame members 112A and 112B. This orients the mold 100 in the open position so that the concrete member 144 may be removed from the mold 100. In the example of FIG. 7, side-panel member 116A is rotated outwardly relative to hold-down member 112A first, then side-panel member 116B is rotated outwardly relative to hold-down member 112B due to the shape of the chamfering at the joint 128 between the two side-panel members 116A-B.

The cured concrete member 144 may be pried from mold 100 while leaving side-panel members 116A-C in their respective positions depicted in FIG. 7. The mold 100 allows the fixed side-panel 116C to be used as a pivot to aid in prying concrete member 144 out of the mold 100. In alternative embodiments, such as that of FIG. 2 for example, each of side-panel members 116A', 116B', 116C' and 116D' may be hinged so that each may be unlocked and rotated outwardly relative to the hold-down members 112 to facilitate removing the member 144 from the mold 100. The concrete member 144 may then be lifted vertically from the mold 100 or slidably removed from the mold 100. In either embodiment, the side-panel members 116 may be returned to the closed position and locked to accept a new pour of concrete for forming a new concrete member 144.

In operation, the side-panel members 116A-C are affixed to the hold-down frame of the mold 100. When the hinged side-panel members 116A-B are locked into a closed position relative to the hold-down members 112A-C, the mold 100 is configured to contain poured concrete to form a concrete member 144. After the concrete member 144 has cured within the mold 100, the side-panel members 116A-C can be unlocked relative to the hold-down members 112A-C and moved into the open position. This allows the concrete member 144 to be removed quickly and easily from the mold 100 without the need to break-down the frame surrounding the concrete member 144. After removing the concrete member 144, the side-panel members 116A-C may be returned to the closed position and re-locked relative to the hold-down members 112A-C. The mold 100 may then be reused to cure another concrete member 144 without the need to rebuild the frame around the mold 100.

The foregoing detailed description of one or more embodiments of the concrete mold has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

What is claimed is:

1. A mold is adapted for making pre-formed concrete elements, wherein the mold comprising:

a casting bed;

a form liner configured to rest on a surface of the casting bed;

a hold-down frame configured to rest above the liner opposite the surface of the casting bed; and a separate form attached to an outer surface of the frame opposite the surface of the liner, the form including a plurality of side-panel members, wherein at least one of the plurality of side-panel members includes at least one hinge member connecting the at least one of the plurality of side-panel members to the frame, wherein each of the plurality of side panel members includes an inside face which faces inwardly when the side panel members are in the closed position and an outside face which faces outwardly when the side panel members are in the closed position, wherein each of the at least one hinge members includes an inner portion which contacts the outside face of the at least one side-panel member and an outer portion which is opposite the inner portion, which contacts the outer surface of the frame, wherein each side-panel member including ends complementarily configured to fit together to create a closed perimeter defined within a single plane, wherein the plurality of side-panels are in a closed position when the ends create a closed perimeter and in an opened position when the at least one of the plurality of side-panel members has been rotated about the at least one hinge member, toward said outer surface of the hold-down frame and the ends of the form no longer create a closed perimeter.

2. The mold of claim 1, wherein the at least one of the hinge members includes at least one longitudinal opening on the outer portion, the frame includes as least one hinge eyelet to correspond with each longitudinal opening, a cotter pin is configured to be inserted contemporaneously into the at least one longitudinal opening and the at least one hinge eyelet to allow the at least one side-panel member to rotate around the hinge member at the outer portion.

3. The mold of claim 2, wherein the at least one of the hinge members includes at least one hold-down collar on the inner portion, the frame includes at least one hold-down post to correspond with each hold-down collar, a hold-down pin is configured to be inserted contemporaneously into the at least one hold-down collar and the at least one hold-down post to retain the plurality of side-panel members in the closed position, the hold-down pin is configured to be removed from the at least one hold-down collar and the at least one hold-down post to allow the side-panel members to be rotated to the opened position.

4. The mold of claim 3, wherein the hinge members are sized relative to the casting bed such that when the side-panel member rotates around the hinge member to the opened position, the side-panel member lies flush with a top surface of the casting bed.

5. The mold of claim 3, wherein the hold-down pin is integrated with the at least one hold-down post.

6. The mold of claim 3, wherein the hold-down pin is integrated with the at least one hold-down collar.

7. A mold is adapted for making pre-formed concrete elements, wherein the mold comprising:

a casting bed;

a form liner configured to rest on a surface of the casting bed;

a hold-down frame configured to rest above the liner opposite the surface of the casting bed, the frame being contiguous such that it forms a closed perimeter, the frame having a surface arranged opposite the surface of the liner when the frame is resting on the surface of the liner; and a separate form including a plurality of side-panel members each of which is attached to an outer surface of the frame opposite the surface of the liner, wherein at least one of the plurality of side-panel members includes at least one hinge member connecting the at least one of the plurality of side-panel members to the frame, wherein each of the plurality of side panel members includes an inside face which faces inwardly when the side panel members are in the closed position and an outside face which faces outwardly when the side panel members are in the closed position, wherein each of the at least one hinge members includes an inner portion which contacts the outside face of the at least one side-panel member and an outer portion which is opposite the inner portion, which contacts the outer surface of the frame, wherein each side-panel member including ends complementarily configured to fit together to create a closed perimeter, wherein the closed perimeter of the form is coextensive with the closed perimeter of the frame; wherein the plurality of side-panels are in a closed position when the ends create the closed perimeter and in an opened position when the at least one of the plurality of side-panel members has been rotated about the at least one hinge member, toward said outer surface of the hold-down frame and the ends of the form no longer create the closed perimeter.

8. The mold of claim 7, wherein the at least one of the hinge members includes at least one hold-down collar, the frame includes at least one hold-down post to correspond with each hold-down collar, a hold-down pin is configured to be inserted contemporaneously into the at least one hold-down collar and the at least one hold-down post to retain the plurality of side-panel members in the closed position, the hold-down pin is configured to be removed from the at least one hold-down collar and the at least one hold-down post to allow the side-panel members to be rotated to the opened position.

9. The mold of claim 8, wherein the hinge members are sized relative to the casting bed such that when the side-panel member rotates around the hinge member to the opened position, the side-panel member lies flush with a top surface of the casting bed.

* * * * *